US006712988B2

(12) United States Patent
Klein

(10) Patent No.: US 6,712,988 B2
(45) Date of Patent: Mar. 30, 2004

(54) SPIN FINISH

(75) Inventor: Ralf Klein, Midlothian, VA (US)

(73) Assignee: Honeywell International Inc., Morristown, NJ (US)

( * ) Notice: Subject to any disclaimer, the term of this patent is extended or adjusted under 35 U.S.C. 154(b) by 34 days.

(21) Appl. No.: 10/163,976

(22) Filed: Jun. 6, 2002

(65) Prior Publication Data

US 2003/0035952 A1 Feb. 20, 2003

Related U.S. Application Data

(62) Division of application No. 09/418,657, filed on Oct. 15, 1999, now Pat. No. 6,426,142.

(60) Provisional application No. 60/146,487, filed on Jul. 30, 1999.

(51) Int. Cl.[7] ..... D06M 51/33; D06M 13/17

(52) U.S. Cl. ..... 252/8.81; 252/8.82; 252/8.83; 252/8.48

(58) Field of Search ..... 252/8.81, 8.82, 252/8.83, 8.84

(56) References Cited

U.S. PATENT DOCUMENTS

| | | | | |
|---|---|---|---|---|
| 3,338,830 A | | 8/1967 | Stokes et al. | 252/8.9 |
| 3,672,977 A | | 6/1972 | Dardoufas | 117/138.8 |
| 3,681,244 A | | 8/1972 | Obetz et al. | 252/8.8 |
| 3,730,892 A | | 5/1973 | Marshall et al. | 252/8.75 |
| 3,781,202 A | | 12/1973 | Marshall et al. | 252/8.7 |
| 3,850,658 A | | 11/1974 | Gomez et al. | 117/7 |
| 3,940,544 A | | 2/1976 | Marshall et al. | 428/378 |
| 4,019,990 A | | 4/1977 | Marshall et al. | 252/8.9 |
| 4,108,781 A | | 8/1978 | Marshall et al. | 252/8.9 |
| 4,137,181 A | | 1/1979 | Hawkins | 252/8.9 |
| 4,210,700 A | | 7/1980 | Marshall et al. | 428/395 |
| 4,293,305 A | | 10/1981 | Wilson | 8/115.6 |
| 4,294,883 A | | 10/1981 | Hawkins | 428/361 |
| 4,340,382 A | | 7/1982 | Morlino et al. | 8/137 |
| 4,348,517 A | | 9/1982 | Chakravarti | 523/425 |
| 4,351,738 A | | 9/1982 | Takahashi et al. | 252/8.75 |
| 4,371,658 A | | 2/1983 | Marshall et al. | 524/585 |
| 4,426,297 A | | 1/1984 | Wilson | 252/8.6 |
| 4,442,249 A | | 4/1984 | Lees et al. | 523/455 |
| 4,602,916 A | | 7/1986 | Wilson | 8/580 |
| 4,722,738 A | | 2/1988 | Wilson | 8/527 |
| 4,946,375 A | | 8/1990 | Day | 428/395 |
| 5,132,067 A | | 7/1992 | Nelson et al. | 264/210.8 |
| 5,232,742 A | | 8/1993 | Chakravarti | 427/387 |
| 5,507,989 A | | 4/1996 | Makino et al. | 264/130 |
| 5,552,671 A | | 9/1996 | Parham et al. | 313/635 |
| 5,630,976 A | | 5/1997 | Nelson et al. | 264/210.8 |
| 5,869,582 A | | 2/1999 | Tang et al. | 525/415 |
| 6,365,065 B1 | * | 4/2002 | Klein | 252/8.81 |
| 6,426,142 B1 | * | 7/2002 | Klein | 428/378 |
| 2002/0171061 A1 | * | 11/2002 | Klein | 252/8.81 |

FOREIGN PATENT DOCUMENTS

| | | |
|---|---|---|
| EP | 0 270 213 A2 | 9/1987 |
| EP | 0 516 412 A2 | 5/1992 |
| JP | 15319 | 1/1987 |
| WO | WO 96/06971 | 3/1996 |
| WO | WO 98/15685 | 4/1998 |

* cited by examiner

*Primary Examiner*—Cynthia H. Kelly
*Assistant Examiner*—J. M. Gray
(74) *Attorney, Agent, or Firm*—Margaret S. Millikin

(57) ABSTRACT

A spin finish applied to industrial yarn. It enhances yarn processability as evidenced by low fuming, improved mechanical quality at lower amounts of spin finish per yarn, improved mechanical quality at higher draw ratios, and minimal depositing. It improves yarn performance as evidenced by improved strength and wicking.

11 Claims, 5 Drawing Sheets

SPIN FINISH

This application is a divisional of application Ser. No. 09/418,657 filed Oct. 15, 1999, now U.S. Pat. No. 6,426,142, Which claims priority to U.S. Provisional application No. 60/146,487, filed Jul. 30, 1999.

The present invention relates to a spin finish for synthetic fiber.

BACKGROUND OF THE INVENTION

Upon emerging from a spinneret, many synthetic fibers require the application of a spin finish in order to further process the spun yarn. Because a spin finish may be present in a minimal layer on fiber, the spin finish acts as an interface between the fiber and the metallic surfaces such as guides and rollers which contact the fiber during such processing as drawing or relaxing.

The art teaches many spin finishes for conventional industrial, carpet, and textile yarn. For example, spin finishes comprising lubricants of polyalkylene glycols with molecular weights of 300 to 1,000 and a second component are taught by U.S. Pat. No. 4,351,738 (see Comparative Examples) and commonly assigned U.S. Pat. Nos. 3,940,544; 4,019,990; and 4,108,781. U.S. Pat. No. 4,340,382 teaches a finish comprising a nonionic surfactant of polyalkylene glycol block copolymer.

Spin finishes comprising lubricants of polyalkylene glycols with molecular weights of greater than 1,000 and other components such as esters, an anionic compound, or polyalkylene oxide modified polysiloxane are taught by U.S. Pat. Nos. 3,338,830; 4,351,738 and 5,552,671 and Research Disclosures 19432 (June 1980) and 19749 (September 1980). See also Kokai Patent Publication 15319 published Jan. 23, 1987. Unfortunately, spin finishes comprising polyalkylene glycols wherein the preferred or lowest molecular weight exemplified is ≧2,000 may form deposits on the metallic surfaces which they contact during manufacturing.

U.S. Pat. No. 5,507,989 teaches a spin finish wherein the boundary lubricant is a polyalkylene glycol having a molecular weight of ≧9,000.

U.S. Pat. No. 4,442,249 teaches a spin finish comprising an ethylene oxide/propylene oxide block copolymer with a molecular weight greater than 1,000; an alkyl ester or dialkyl ester or polyalkyl ester of tri- to hexaethylene glycol lubricant; and a neutralized fatty acid emulsifier. Unfortunately, spin finishes comprising these block copolymers also may form deposits on the metallic surfaces which they contact during manufacturing and these textile spin finish compositions may be inadequate for the more severe conditions used in industrial fiber production.

Commonly assigned U.S. Pat. Nos. 3,681,244; 3,781,202; 4,348,517; 4,351,738 (15 moles or less of polyoxyethylene); and 4,371,658 teach the use of polyoxyethylene castor oil in spin finishes.

Another spin finish composition for conventional industrial yarn is taught by commonly assigned U.S. Pat. No. 3,672,977 which exemplifies a spin finish comprising coconut oil, ethoxylated lauryl alcohol, sodium petroleum sulfonate, ethoxylated tallow amine, sulfonated succinic ester, and mineral oil. See also commonly assigned U.S. Pat. Nos. 3,681,244; 3,730,892; 3,850,658; and 4,210,710.

Over the years, processes for manufacturing industrial yarns have become more demanding. See for example the processes for making dimensionally stable polyester fiber taught by commonly assigned U.S. Pat. Nos. 5,132,067; 5,397,527; and 5,630,976. Further, a general trend exists in the yarn converting industry towards direct cabling machines to reduce conversion costs. Cost reductions are achieved in part, as direct cabling machines operate at considerably higher speeds (30–50% greater) and complete two steps at once compared to conventional ring twisters. However, the demands placed on the yarn finish to preserve yarn mechanical quality are much greater with direct cabling machines. Thus, a spin finish which enhances yarn processability and contributes to improved yarn performance is needed in the art.

SUMMARY OF THE INVENTION

We have developed a spin finish which responds to the foregoing need in the art. The present spin finish composition comprises at least about 10 percent by weight based on the spin finish composition of components (a) and (b) having the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms or an alkylene hydroxy group having from one to 22 carbon atoms, x is zero or one, $R_2$ may vary within component (a) or component (b) and is selected from the group consisting of hydrogen or an alkyl group having from one to four carbon atoms, y is zero, or from one to 25, and z is zero or one, in component (a), x and z are equal to zero and the average molecular weight of component (a) is less than or equal to 1,900 and if $R_2$ varies, component (a) is a random copolymer; and in component (b), at least x or z is equal to one or component (b) is a complex polyoxyethylene glyceride-containing compound having greater than 10 polyoxyethylene units;

up to five percent by weight based on the spin finish composition of component (c) of an alkoxylated silicone; and at least about one percent by weight based on the spin finish composition of component (d) having the formula $$R_4(CH_2O(CO)_aR_5)_b$$

wherein $R_4$ is —C— or —COC—; a is 0 or 1; $R_5$ is —H; from —$CH_3$ to —$C_{18}H_{37}$; or —$CH(R_6)$—$CH_2O$; b is 4 or 6; and $R_6$ is —H or —$CH_3$ or —H and —$CH_3$ in a ratio of 10:90 to 90:10.

The present invention is advantageous compared with conventional spin finishes applied to industrial yarn because the present spin finish enhances yarn processability as evidenced by low fuming, improved mechanical quality at lower amounts of spin finish per yarn, improved mechanical quality at higher draw ratios, and minimal depositing and improves yarn performance as evidenced by improved strength and wicking.

Other advantages of the present invention will be apparent from the following description and attached claims.

DETAILED DESCRIPTION OF THE PREFERRED EMBODIMENTS

Figure 1:
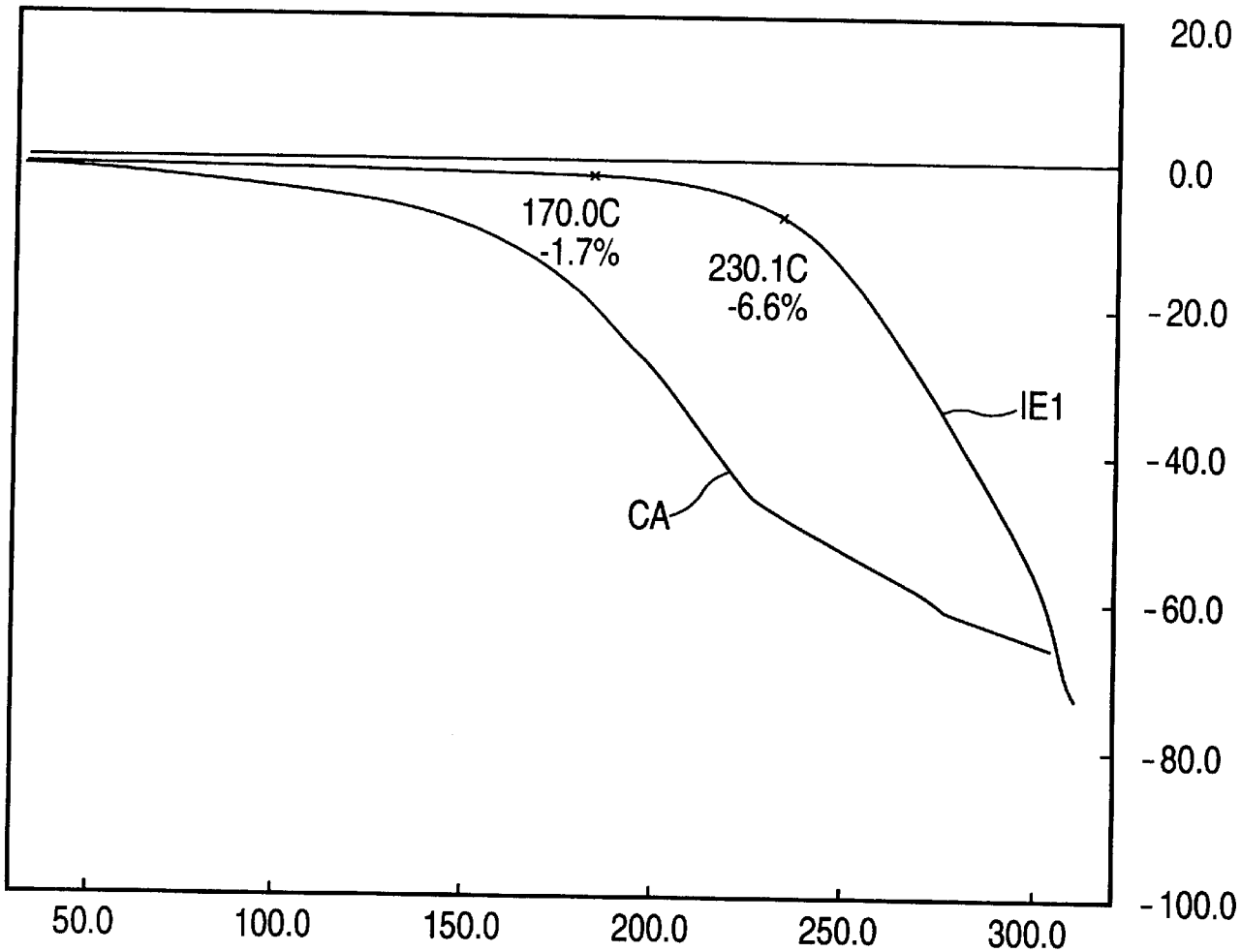
FIG. 1 shows the thermogravimetric analysis for a known spin finish and Inventive Example 1.

Component (a) of the present spin finish composition has the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms, x and z are zero, $R_2$ may vary and is selected from the group consisting of hydrogen or an alkyl group having from one to four carbon atoms, and y is zero, or from one to 25. The average molecular weight of component (a) is less than or equal to 1,900.

Preferably, the average molecular weight of component (a) is greater than 500. More preferably, the average molecular weight of component (a) is less than about 1,500.

Preferably, in component (a), each of $R_1$ and $R_3$ is selected from the group consisting of hydrogen or an alkyl group having from one to ten carbon atoms, $R_2$ varies and is selected from the group consisting of hydrogen and an alkyl group having one or two carbon atoms, and y is zero or between one to 20. The term "$R_2$ varies" means that $R_2$ may be hydrogen and methyl, hydrogen and ethyl, or methyl and ethyl. More preferably, in component (a), each of $R_1$ and $R_3$ is selected from the group consisting of hydrogen or an alkyl group having from one to five carbon atoms atoms, $R_2$ is selected from the group consisting of hydrogen and an alkyl group having one carbon atom, and y is zero or between one to 16.

Preferred component (a) is a so-called random copolymer, and more preferably, a random copolymer made from ethylene oxide and propylene oxide. Ethylene oxide, propylene oxide, and an alcohol are reacted simultaneously to form mixed polyalkylene glycol compounds with an alcohol terminated end. Preferred compounds are condensation products of about 30 to about 70 percent by weight ethylene oxide and about 30 to about 70 percent by weight propylene oxide and are terminated with an alcohol having one to four carbon atoms. Useful random copolymers are commercially available.

Preferably, component (a) is present in an amount of at least about 10 percent by weight based on the spin finish composition. More preferably, component (a) is present in an amount of at least about 20 percent by weight based on the spin finish composition. Component (b) of the present spin finish has the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms or an alkylene hydroxy group having from one to 22 carbon atoms, x is zero or one, $R_2$ may vary and is selected from the group consisting of hydrogen or an alkyl group having from one to four carbon atoms, z is zero or one, and at least x or z is equal to one. Component (b) may be a mixture of components or may be a complex polyoxyethylene glyceride-containing compound having greater than 10 polyoxyethylene units.

Preferably, in component (b), each of $R_1$ and $R_3$ is selected from the group consisting of hydrogen or an alkyl group having from one to 18 carbon atoms or alkylene hydroxy group having from one to 18 carbon atoms, $R_2$ does not vary and is selected from the group consisting of hydrogen or an alkyl group having one or two carbon atoms, and y is from 5 to 25. More preferably, in component (b), x is one and z is zero.

Useful complex esters are commercially available.

The most preferred component (b) is a polyoxyethylene glyceride-containing compound having greater than 10 polyoxyethylene units and the most preferred polyoxyethylene glyceride-containing compound having greater than 10 polyoxyethylene units is ethoxylated castor oil.

Preferably, component (b) is present in an amount of at least about five percent by weight based on the spin finish composition.

Component (c) is an alkoxylated silicone. Preferably, the alkoxylated silicone has a siloxane backbone with organic polyalkylene oxide pendants. Useful alkoxylated silicones are commercially available. The alkoxylated silicone is used in an amount of up to about five percent by weight based on the spin finish composition.

Component (d) of the present spin finish has the formula $$R_4(CH_2O(CO)_aR_5)_b$$

wherein $R_4$ is —C— or —COC—; a is 0 or 1; $R_5$ is —H; from —$CH_3$ to —$C_{18}H_{37}$; or —$CH(R_6)$—$CH_2O$; b is 4 or 6; and $R_6$ is —H or —$CH_3$ or —H and —$CH_3$ in a ratio of 10:90 to 90:10. Examples of useful component (d) include dipentaerythritol hexaheptanoate; dipentaerythritol triheptanoate trinonanoate; dipentaerythritol triheptanoate triisononanoate; dipentaerythritol monocarboxylic ($C_{5-9}$) fatty acids hexaester; dipentaerythritol enanthate, oleate; dipentaerythritol mixed ester of valeric acid, caproic acid, enanthylic acid, acrylic acid, pelargonic acid, and 2-methylbutyric acid; pentaerythritol tetrapelargonate; and dipentaerythritol hexapelargonate. Useful component (d) is commercially available.

Preferably, component (d) is present in an amount of at least about one percent by weight based on the spin finish composition.

The present spin finish may be used on any synthetic fiber. Useful synthetic materials include polyesters and polyamides. Useful polyesters include linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-dibenzofurandicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyester include poly(ethylene terephthalate); poly(butylene terephthalate); poly(ethylene terephthalate/5-chloroisophthalate)(85/15); poly(ethylene terephthalate/5-[sodium sulfo]isophthalate)(97/3); poly(cyclohexane-1,4-dimethylene terephthalate), and poly(cyclohexane-1,4-dimethylene terephthalate/hexahydroterephthalate). These starting synthetic materials are commercially available.

Another useful polymer is the copolymer taught by commonly assigned U.S. Pat. No. 5,869,582. The copolymer comprises: (a) a first block of aromatic polyester having: (i) an intrinsic viscosity which is measured in a 60/40 by weight mixture of phenol and tetrachloroethane and is at least about 0.6 deciliter/gram and (ii) a Newtonian melt viscosity which is measured by capillary rheometer and is at least about 7,000 poise at 280° C.; and (b) a second block of lactone monomer. Examples of preferred aromatic polyesters include poly(ethylene terephthalate)("PET"), poly(ethylene naphthalate)("PEN"); poly(bis-hydroxymethylcyclohexene terephthalate); poly(bis-hydroxymethylcyclohexene naphthalate); other polyalkylene or polycycloalkylene naphthalates and the mixed polyesters which in addition to the ethylene terephthalate unit, contain components such as ethylene isophthalate, ethylene adipate, ethylene sebacate, 1,4-cyclohexylene dimethylene terephthalate, or other alkylene terephthalate units. A mixture of aromatic polyesters may also be used. Commercially available aromatic polyesters may be used. Preferred lactones include ϵ-caprolactone, propiolactone, butyrolactone, valerolactone, and higher cyclic lactones. Two or more types of lactones may be used simultaneously.

Useful polyamides include nylon 6; nylon 66; nylon 11; nylon 12; nylon 6,10; nylon 6,12; nylon 4,6; copolymers thereof, and mixtures thereof.

The synthetic fiber may be produced by known methods for making industrial fiber. For example, commonly assigned U.S. Pat. Nos. 5,132,067 and 5,630,976 teach methods for making dimensionally stable PET. Afte: the synthetic fiber emerges from a spinneret, the present spin finish may be applied to the synthetic fiber by any known means including bath, spray, padding, and kiss roll applications. Preferably, the present spin finish is applied to the synthetic yarn in an amount of about 0.1 to about 1.5 percent by weight based on the weight of the synthetic yarn.

The following test methods were used to analyze fiber having the present spin finish composition thereon.

1. Thermogravimetric Analysis: Thermogravimetric analysis was conducted on a Seiko RTG 220U instrument using open platinum pans. Samples between 5 and 8 milligrams in weight were heated from 30° C. to 300° C. at 10° C./minute under an air purge at 200 milliliters/minute.

2. Fray Count: Yarn defect level was measured on-line using the Enka Tecnica FR-20 type Fraytec system. The fray counting sensor was mounted on the compaction panel between the commingling jet and the winding tension detector. A bending angle of greater than 2 degrees was maintained. The sensor was cleaned during every other doff to ensure the accurate measurement.

3. Breaking Strength: Breaking strength was determined according to ASTMD885 (1998). For each yarn tested, ten tests were conducted and the average of the ten tests was reported.

4. Wicking Cord Test Method: This test method covers determination of dip wicking ability on untreated or treated cords. A yarn or cord is vertically immersed in a container filled with dip. The dip permeability through fiber capillary in two minutes is then measured by tracking the vertical progress of the dyed dip.

The apparatus includes two ring stands for holding test cords, dip container of one inch diameter and one inch depth, and control motor (⅛ Hp with manual rpm control) to feed test yarn through apparatus.

All test specimens must be conditioned at least 24 hours at atmosphere of 70° F. and 65% relative humidity as directed in ASTM D1776.

For the test procedure, step 1 is to mix three drops of red dye well with dip solution. Step 2 is to pull the test cord through a sample holder in the order of a first ring stand, dip container, and a second ring stand to the control motor. Wind the cord on the pulley of the control motor. Finally, apply 20 gms pretension weight on the cord between the first ring stand and the ruler. Step 3 is to fill the dip container with the colored dip. Make sure dip level is at the top edge of the dip container, even with the "0" on the ruler. Step 4 is to turn on the motor and feed a section of yarn through the dip. Stop the motor and start the test. Step 5 is to allow dip to wick two minutes on the specimen. Measure and report position of colored dip as it climbs the sample. Repeat steps 4 and 5 for nine times per fiber. Calculate average and standard deviation of ten wicking reading.

The following examples are illustrative and not limiting.

COMPARATIVE A AND INVENTIVE EXAMPLE 1

Comparative A was an industrial yarn spin finish composition taught by commonly assigned U.S. Pat. No. 3,672,977 and comprised 30 weight percent coconut oil; 13 weight percent ethoxylated lauryl alcohol; 10 weight percent sodium petroleum sulfonate; 5 weight percent ethoxylated tallow amine; 2 weight percent sulfonated succinic ester; and 40 weight percent mineral oil.

For Inventive Example 1, commercially available component (a) having the formula $$R_1—(CO)_x—O—(CH(R_2)—CH_2—O)_y—(CO)_z—R_3$$

as described in Table I below was used

TABLE I

| MW | $R_1$ | X | $R_2$ | Y | Z | $R_3$ |
|---|---|---|---|---|---|---|
| 950 | $C_4$ | O | 50% H/50% $CH_3$ | 4–16 | O | H |

In an amount of 65 weight percent. In Table I, MW means molecular weight. Component (b) was a commercially available ethoxylated castor oil which contained components such as:

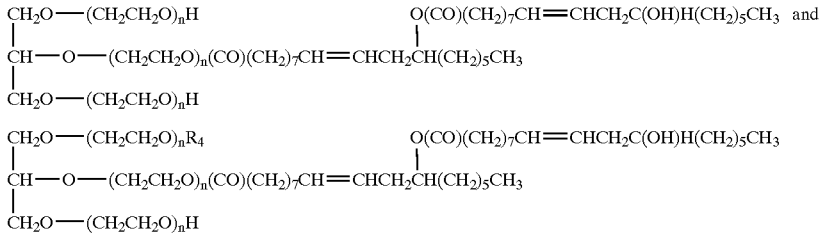

-continued $$O(CO)(CH_2)_7CH{=}CHCH_2C(OH)H(CH_2)_5CH_3$$

Where $R_4$ is $(CO)(CH_2)_7CH{=}CHCH_2CH(CH_2)_5CH_3$ and was used in an amount of 25 weight percent. For component c), silicone was used in an amount of 5 weight percent. For component (d), dipentaerythritol hexapelargonate was used in an amount of 5 weight percent.

In FIG. 1, the thermogravimetric analysis for Inventive Example 1 ("IE1") and Comparative A ("CA") is plotted and shows that as temperature increases, less fuming occurs with Inventive Example 1.

Figure 2:
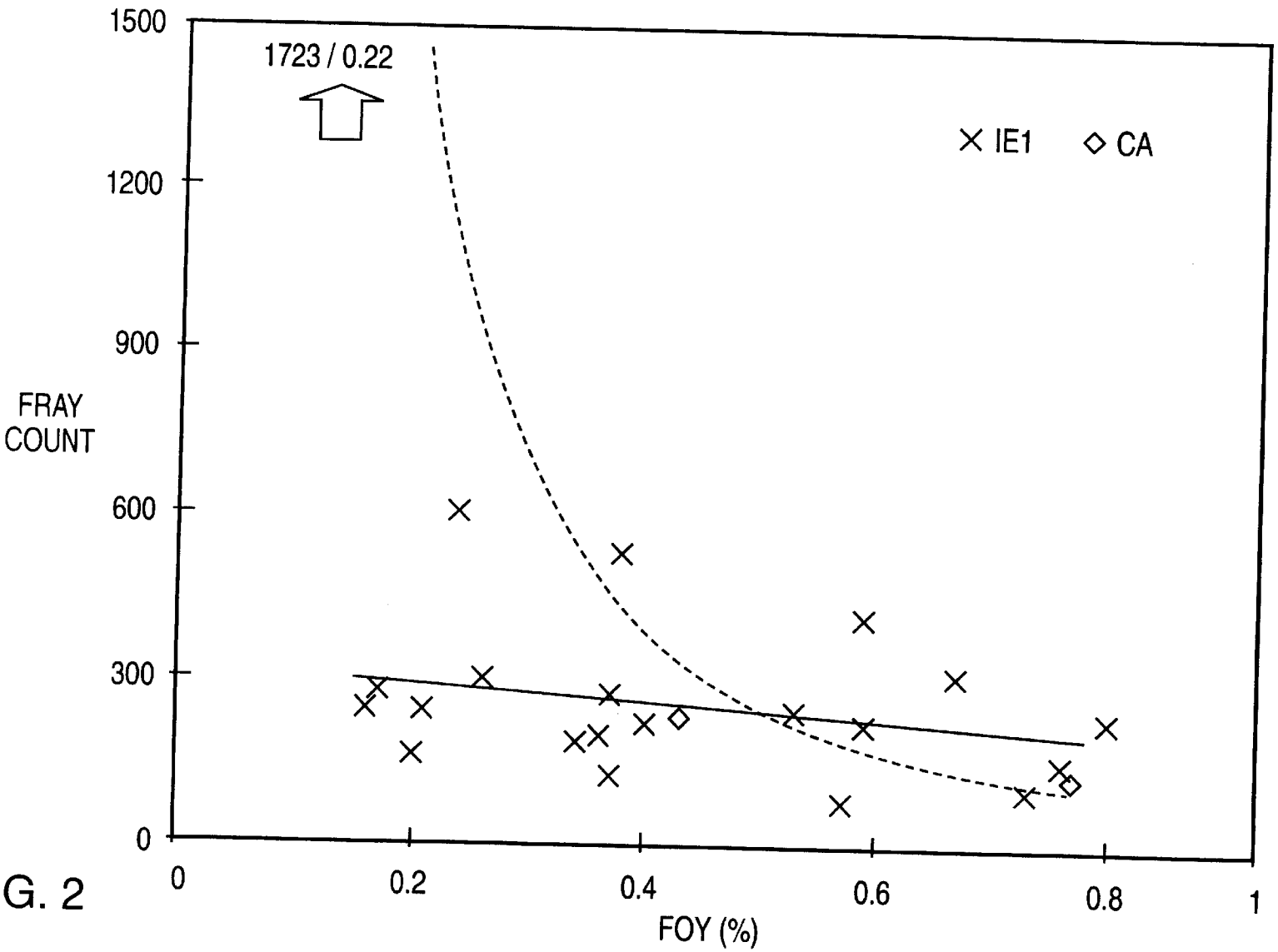
FIG. 2 illustrates the quality for a given amount of spin finish for a known spin finish and Inventive Example 1.

In FIG. 2, the fray count or quality is plotted as a function of the amount of spin finish on an industrial polyester yarn which was 1,000 denier and had 384 filaments. Above 600 fray is unacceptable quality and thus, at least 0.35 weight percent Comparative A ("CA") spin finish was needed on the yarn. A yarn having Inventive Example 1 ("IE1") spin finish has acceptable quality, in other words below 600 fray count, when the yarn has at least 0.35 weight percent Inventive Example 1 spin finish and unexpectedly when the yarn has less than 0.35 down to 0.15 weight percent Inventive Example 1 spin finish. Reduced finish levels are desirable for many end-use applications.

Figure 3:
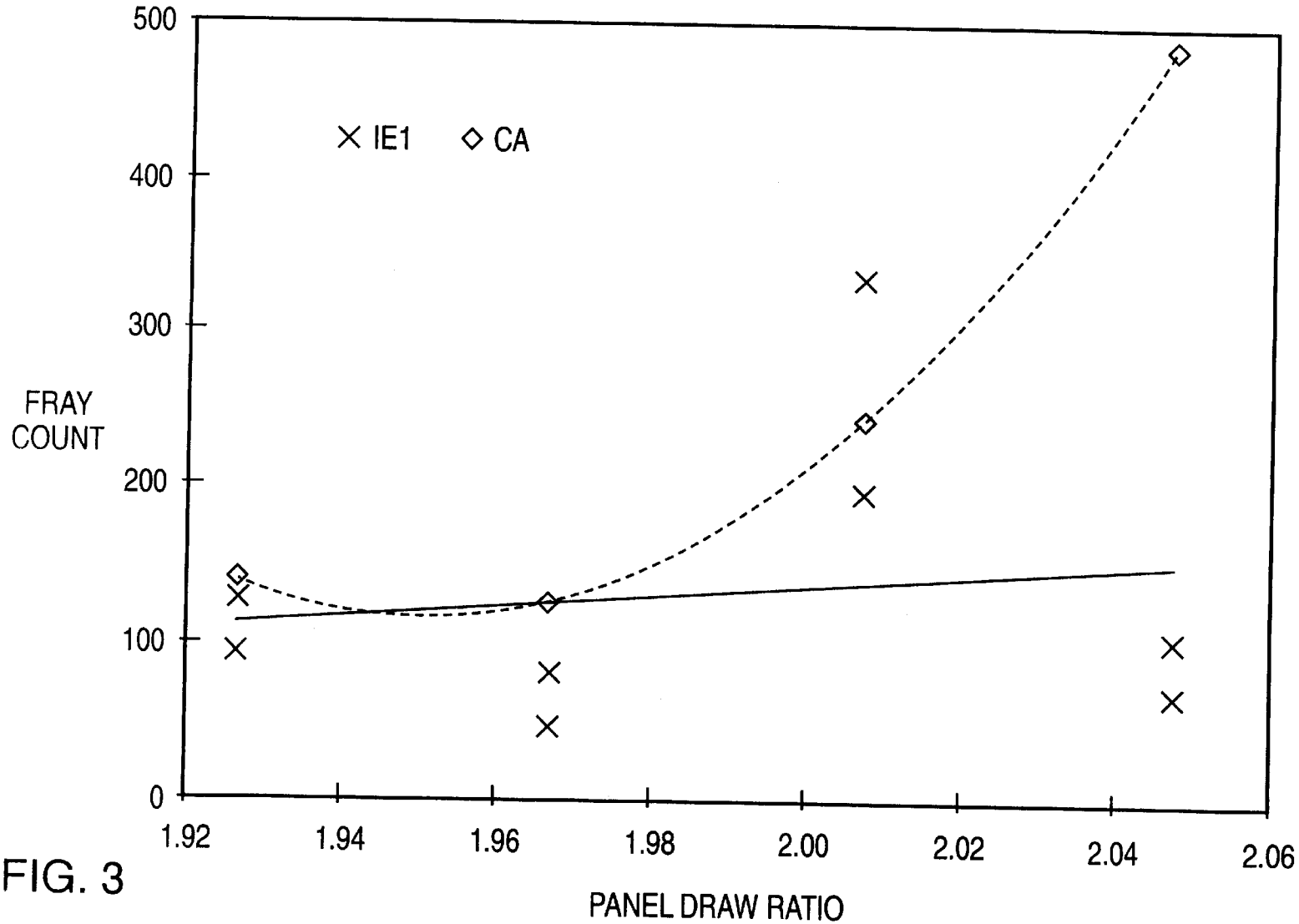
FIG. 3 illustrates the quality for a given draw ratio for a known spin finish and Inventive Example 1.

In FIG. 3, the fray count or quality is plotted as a function of the maximum draw ratio on an industrial polyester yarn which was 1,000 denier and had 384 filaments for Comparative A ("CA") and Inventive Example 1 ("IE1").

Each spin finish was applied in an amount of 0.5 weight percent to industrial polyester yarn.

Figure 4:
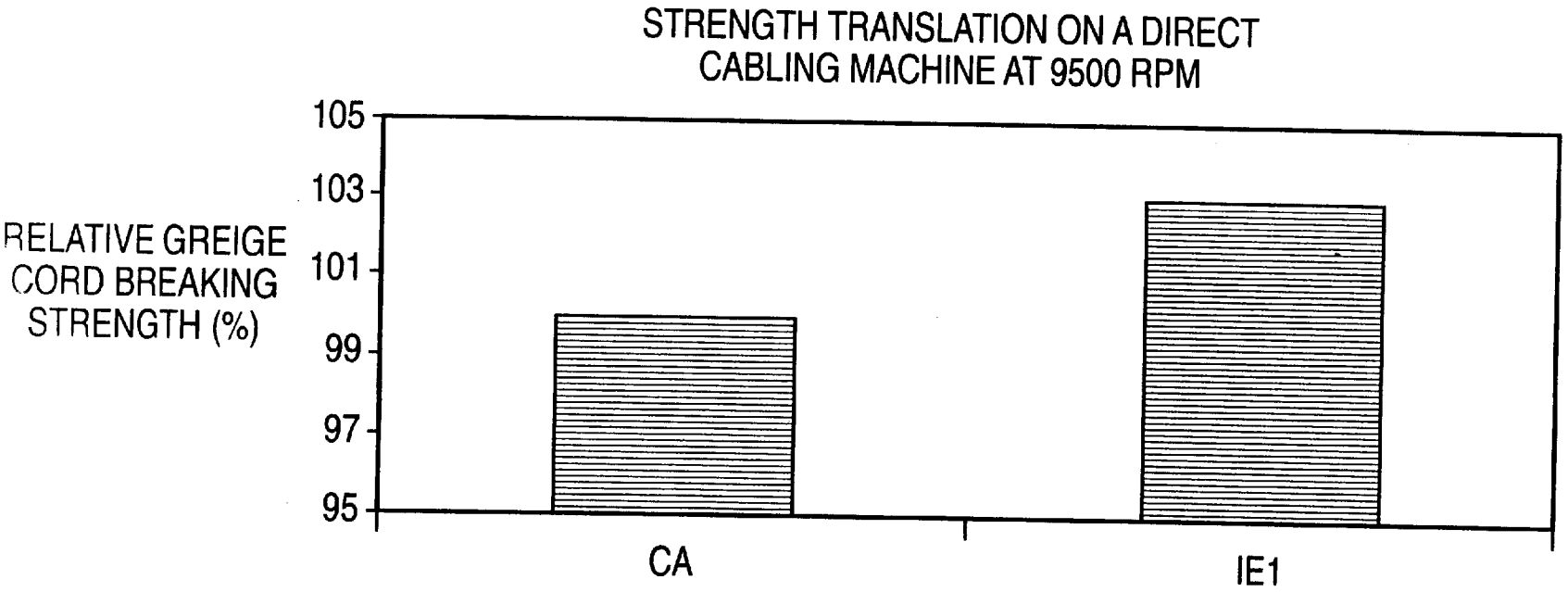
FIG. 4 shows the strength translation improvement on a direct cabling machine for a known spin finish and Inventive Example 1.

For FIG. 4, a 1100 dtex dimensionally stable polyester yarn was cabled to a nominal twist of 470×470 tpm which is a standard construction for tire applications. The yarn was subjected to a state-of-the-art direct cabler which operated at 9500 rpm. Three samples were cabled on two different machines to minimize any specific performance of a cabler. In FIG. 4, Comparative A ("CA") is set at 100% and Inventive Example 1 ("IE1") is reported relative to Comparative A. Inventive Example 1 shows that the present spin finish on an industrial polyester yarn resulted in at least about 3% superior strength. Fiber strength is a major factor in the design of fiber composite systems such as those used in tires. Increased strength enhances performance but also allows consideration to be given to cost savings through material reduction.

Figure 5:
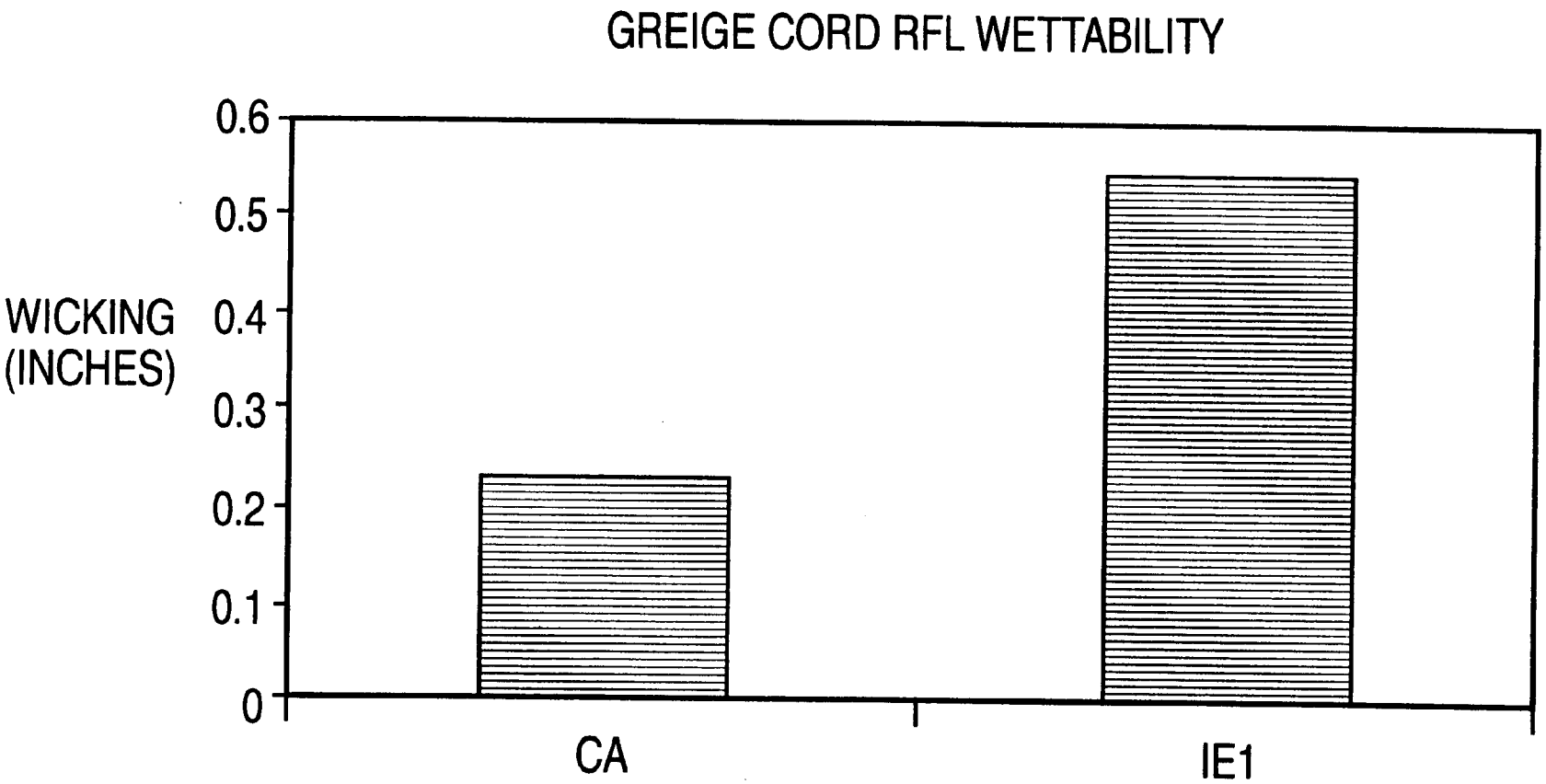
FIG. 5 shows the wicking length for a known spin finish and Inventive Example 1.

In FIG. 5, the wicking of Comparative A ("CA") and Inventive Example 1 ("IE1") were determined. This improved wicking leads to improved dip pickup which results in improved in-rubber performance.

INVENTIVE EXAMPLE 2

For Inventive Example 2, commercially available component (a) having the formula $$R_1{-}(CO)_x{-}O{-}(CH(R_2){-}CH_2{-}O)_y{-}(CO)_z{-}R_3$$

as described in Table II below was used

TABLE II

| MW | $R_1$ | X | $R_2$ | Y | Z | $R_3$ |
|---|---|---|---|---|---|---|
| 950 | $C_4$ | O | 50% H/50% $CH_3$ | 4–16 | O | H |

In an amount of 5 weight percent. In Table II, MW means molecular weight. Component (b) was pentaerythritol ester and was used in an amount of 85 weight percent. For component (c), silicone was used in an amount of 5 weight percent. For component (d), dipentaerythritol hexapelargonate was used in an amount of 5 weight percent. The spin finish was applied in an amount of 0.6 weight percent to industrial polyester yarn. The tenacity of the yarn was 9 grams/denier.

What is claimed is:

1. A spin finish composition comprising at least about 10 percent by weight based on said spin finish composition of components (a) and (b) having the formula $$R_1{-}(CO)_x{-}O{-}(CH(R_2){-}CH_2{-}O)_y{-}(CO)_z{-}R_3$$

wherein each of said $R_1$ and said $R_3$ is selected from the group consisting of hydrogen or an alkyl group having from one to 22 carbon atoms or an alkylene hydroxy group having from one to 22 carbon atoms, said x is zero or one, said $R_2$ may vary within said component (a) or said component (b) and is selected from the group consisting of hydrogen or an alkyl group having from one to four carbon atoms, said y is zero, or from one to 25, and said z is zero or one, in said component (a), said x and z are equal to zero and the average molecular weight of said component (a) is less than or equal to 1,900 and if $R_2$ varies, component (a) is a random copolymer; and in said component (b), at least one of said x or said z is equal to one or said component (b) is a complex polyoxyethylene glyceride-containing compound having greater than 10 polyoxyethylene units;

up to about five percent by weight based on said spin finish composition of component (c) of an ethoxylated silicone; and at least about one percent by weight based on said spin finish composition of component (d) having the formula $$R_4(CH_2O(CO)_aR_5)_b$$

wherein $R_4$ is —C— or —COC—; a is 0 or 1; $R_5$ is —H; from —$CH_3$ to —$C_{18}H_{37}$; or —$CH(R_6)$—$CH_{20}$; b is 4 or 6; and $R_6$ is —H or —$CH_3$ or —H and —$CH_3$ in a ratio of 10:90 to 90:10.

2. The spin finish composition of claim 1 wherein said component (a) is present in an amount of at least about 20 percent by weight based on said spin finish composition.

3. The spin finish composition of claim 2 wherein in said component (a), each of said $R_1$ and $R_3$ is selected from the group consisting of hydrogen or an alkyl group having from one to 22 carbon atoms.

4. The spin finish composition of claim 3 wherein in said component (a), each of said $R_1$ and $R_3$ is selected from the group consisting of hydrogen or an alkyl group having from one to ten carbon atoms, said $R_2$ varies and is selected from the group consisting of hydrogen and an alkyl group having one or two carbon atoms, and said y is zero or from one to 20.

5. The spin finish composition of claim 4 wherein the average molecular weight of said component (a) is less than about 1,500.

6. The spin finish composition of claim 5 wherein said component (a) is a random copolymer.

7. The spin finish composition of claim 1 wherein said component (b) is present in an amount of at least about 10 percent by weight based on said spin finish composition.

8. The spin finish composition of claim 1 wherein in said component (b), each of said $R_1$ and $R_3$ is selected from the group consisting of hydrogen or an alkyl group having from one to 22 carbon atoms or an alkylene hydroxy group having from one to 22 carbon atoms, said $R_2$ may vary and is selected from the group consisting of hydrogen or an alkyl group having from one to four carbon atoms, and at least said x or z is equal to one.

9. The spin finish composition of claim 1 wherein said component (b) is a complex polyoxyethylene glyceride-containing compound having greater than 10 polyoxyethylene units.

10. The spin finish composition of claim 9 wherein said complex polyoxyethylene glyceride-containing compound is ethoxylated castor oil.

11. The spin finish composition of claim 1 wherein said component (d) is dipentaerythritol hexapelargonate or pentaerythritol tetrapelargonate.

* * * * *